US006167222A

United States Patent [19]

Lee

[11] Patent Number: 6,167,222

[45] Date of Patent: Dec. 26, 2000

[54] IMAGE FORMATION APPARATUS AND METHOD CAPABLE OF EASILY REMOVING JAMMED PAPER

[75] Inventor: Hyun-cheol Lee, Seoul, Rep. of Korea

[73] Assignee: SamSung Electronics Co., Ltd., Suwon, Rep. of Korea

[21] Appl. No.: 07/980,221

[22] Filed: Nov. 23, 1992

[30] Foreign Application Priority Data

Nov. 19, 1992 [KR] Rep. of Korea ..... 92-21725

[51] Int. Cl.[7] ..... G03G 15/00

[52] U.S. Cl. ..... 399/124; 399/125

[58] Field of Search ..... 355/200, 210, 355/309; 271/119, 121; 399/110, 111, 116, 124, 125

[56] References Cited

U.S. PATENT DOCUMENTS

| | | | |
|---|---|---|---|
| 4,376,579 | 3/1983 | Wakao | 355/211 |
| 4,583,726 | 4/1986 | Nogi et al. | 271/119 X |
| 4,668,072 | 5/1987 | Yasuda | 355/200 X |
| 4,668,076 | 5/1987 | Iseki et al. | 355/200 |
| 4,751,548 | 6/1988 | Lawson | 355/284 |
| 4,772,915 | 9/1988 | Kando | 346/160 |
| 4,862,209 | 8/1989 | Sakamoto et al. | 355/211 |
| 4,873,548 | 10/1989 | Kobayashi et al. | 355/200 |
| 4,905,046 | 2/1990 | Tsunoi et al. | 355/308 |
| 4,908,661 | 3/1990 | Iwata et al. | 355/211 |
| 5,083,158 | 1/1992 | Kashima et al. | 355/200 |
| 5,089,846 | 2/1992 | Tabuchi | 355/200 |
| 5,124,747 | 6/1992 | Haneda et al. | 355/200 |
| 5,186,448 | 2/1993 | Ohsawa et al. | 271/121 X |
| 5,253,854 | 10/1993 | Tanoue et al. | 271/121 X |
| 5,255,903 | 10/1993 | Parsons et al. | 271/119 X |
| 5,300,979 | 4/1994 | Tsukakoshi et al. | 355/200 |
| 5,323,210 | 6/1994 | Inomata | 355/200 |
| 5,333,036 | 7/1994 | Koga | 355/200 |
| 5,379,092 | 1/1995 | Takashima | 355/200 |

FOREIGN PATENT DOCUMENTS

| | | |
|---|---|---|
| 60-48067 | 3/1985 | Japan . |
| 61-198171 | 9/1986 | Japan . |

*Primary Examiner*—Fred L. Braun
*Attorney, Agent, or Firm*—Robert E. Bushnell, Esq.

[57] ABSTRACT

An image formation apparatus capable of easily removing a jammed paper including upper and lower bodies pivotally combined to each other, a photosensitive drum detachably combined with the upper body, an arm provided with an LED and pivotally installed in the upper body so as to facilitate the attachment and detachment of the photosensitive drum, a developing device and a paper supply cassette detachably installed in the lower body, lower rolling means including a paper supply roller and a paper convey roller located on the same axis between the developing device and paper supply cassette, upper rolling means and fixing rollers provided on the opposite of the detaching side of the photosensitive drum installed in the upper body.

29 Claims, 4 Drawing Sheets

IMAGE FORMATION APPARATUS AND METHOD CAPABLE OF EASILY REMOVING JAMMED PAPER

BACKGROUND OF THE INVENTION

The present invention relates to an image formation apparatus using an electrostatic writing method, and more particularly to an image formation apparatus using an electrostatic writing method which has a simplified structure and a shortened path for paper conveyance.

Today, according to the striking development in communications, the transmission speed of information has become surprisingly rapid and various models for visualizing the transmitted information have been presented. Along with the needs for office automation, various information transmission and reproduction apparatuses have been developed Such as telex and facsimile. Among these, image formation apparatuses for reproducing sharp images ranging from characters or symbols to figures and color pictures have become increasingly important.

Meanwhile, such image formation apparatuses are divided into electrostatic writing types and magnetic writing types. In the electrostatic writing type, a photoconductive insulating layer is electrified uniformly and is exposed to light. Then, the charges in the exposed portion are removed to form an electrostatic latent image which is then developed by electrically charged toner and transferred to paper to be fixed thereto by heat and/or pressure, thus ultimately obtaining a picture. In the magnetic writing type, as suggested by its name, a magnetic latent image is formed by a magnetic head on a magnetic drum and is developed and transferred to obtain the final picture.

FIG. 1 illustrates a conventional image formation apparatus using an electrostatic writing method. As shown in FIG. 1, a paper supply cassette 1 is installed in the lower portion of the apparatus. A transferring device 3 is placed under and adjacent to a photosensitive drum 4, and a laser scanning device 5 for protecting image information is installed in the upper portion of the apparatus. A paper supply roller 2 is provided on the top of paper supply cassette 1. Along a paper traveling path 11, register rollers 9 and 9', fixing rollers 8 and 8', paper conveyance rollers 15 and 15', and paper discharging rollers 10 and 10' are provided at specific intervals subsequent to paper supply roller 2. An electrifying device 17 is installed on the top of photosensitive drum 4 and a cleaner 13 for removing toner remaining on photosensitive drum 4 is installed under electrifying device 17.

The operation of the conventional image formation apparatus will be described below in brief.

The top sheet of paper is supplied by paper supply roller 2 from paper supply cassette 1 mounted in the lower portion of the apparatus, and is aligned and propelled by register rollers 9 and 9'. Then, image information is projected from laser scanning device 5 in the upper portion of the apparatus to the surface of photosensitive drum 4 electrified by electrifying device 17, so as to form an electrostatic latent image. Developer is applied to the electrostatic latent image from a developing device 6. Image toner 18 is transferred by transferring device 3 onto the paper conveyed by register rollers 9 and 9'. The image toner 18 transferred on the paper is compressed by fixing rollers 8 and 8' of an image fixing device 7, is conveyed by conveyance rollers 15 and 15', and is then discharged to a paper discharge tray 12 by paper discharging rollers 10 and 10' via an additional guiding device 14 for face-down discharge. Toner remaining on the surface of photosensitive drum 4 after being transferred in the transfer step is removed by cleaner 13.

However, since such a conventional image formation apparatus has an overly long paper feed path (from the paper being supplied from paper supply cassette 1 to it being loaded into paper discharge tray 12 by paper discharging rollers 10 and 10'), paper feed trouble takes place frequently, such as paper jams. Moreover, when this occurs, as the paper is pressed by a plurality of rollers, i.e., 2, 9, 9', 8, 8', 15, 15', 10, and 10', it is very difficult to remove the paper.

SUMMARY OF THE INVENTION

Therefore, it is an object of the present invention to provide an image formation apparatus using an electrostatic writing method which has a simplified structure and a shortened paper feed path.

To accomplish the object, there is provided an image formation apparatus using an electrostatic writing method comprising: upper and lower bodies pivotally combined to each other; a photosensitive drum detachably combined with said upper body; an arm provided with an LED and pivotally installed in the upper body so as to facilitate the attachment of said photosensitive drum; a developing device and a paper supply cassette detachably installed in the lower body; a paper supply roller and a paper convey roller located on the same axis between the developing device and paper supply cassette, image fixing rollers provided opposite of the detaching side of the photosensitive drum installed in the upper body.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Figure 1:
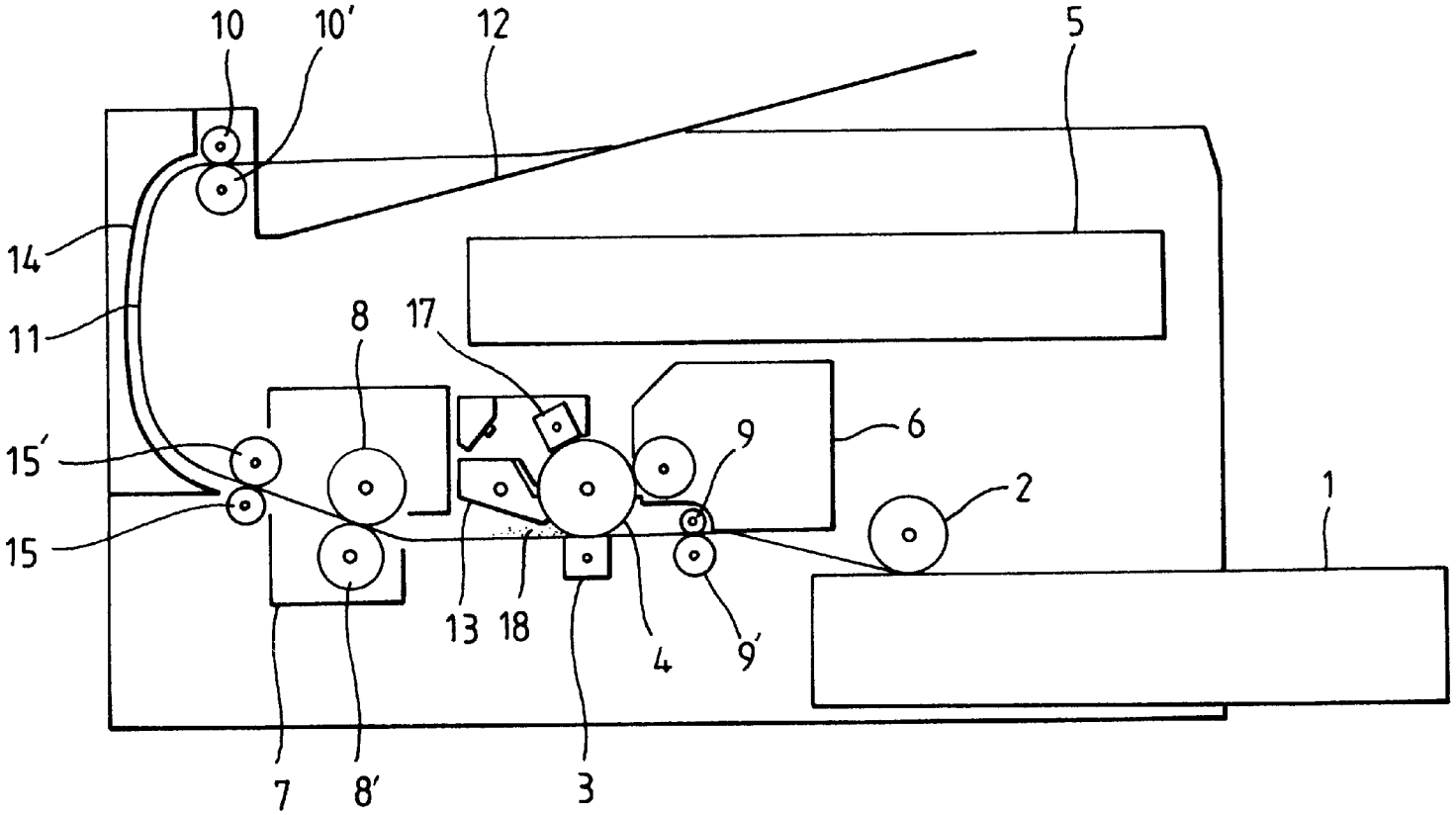
FIG.1 (PRIOR ART)
FIG. 1 is a schematic view of a conventional image formation apparatus using electrostatic writing method.
Figure 2:
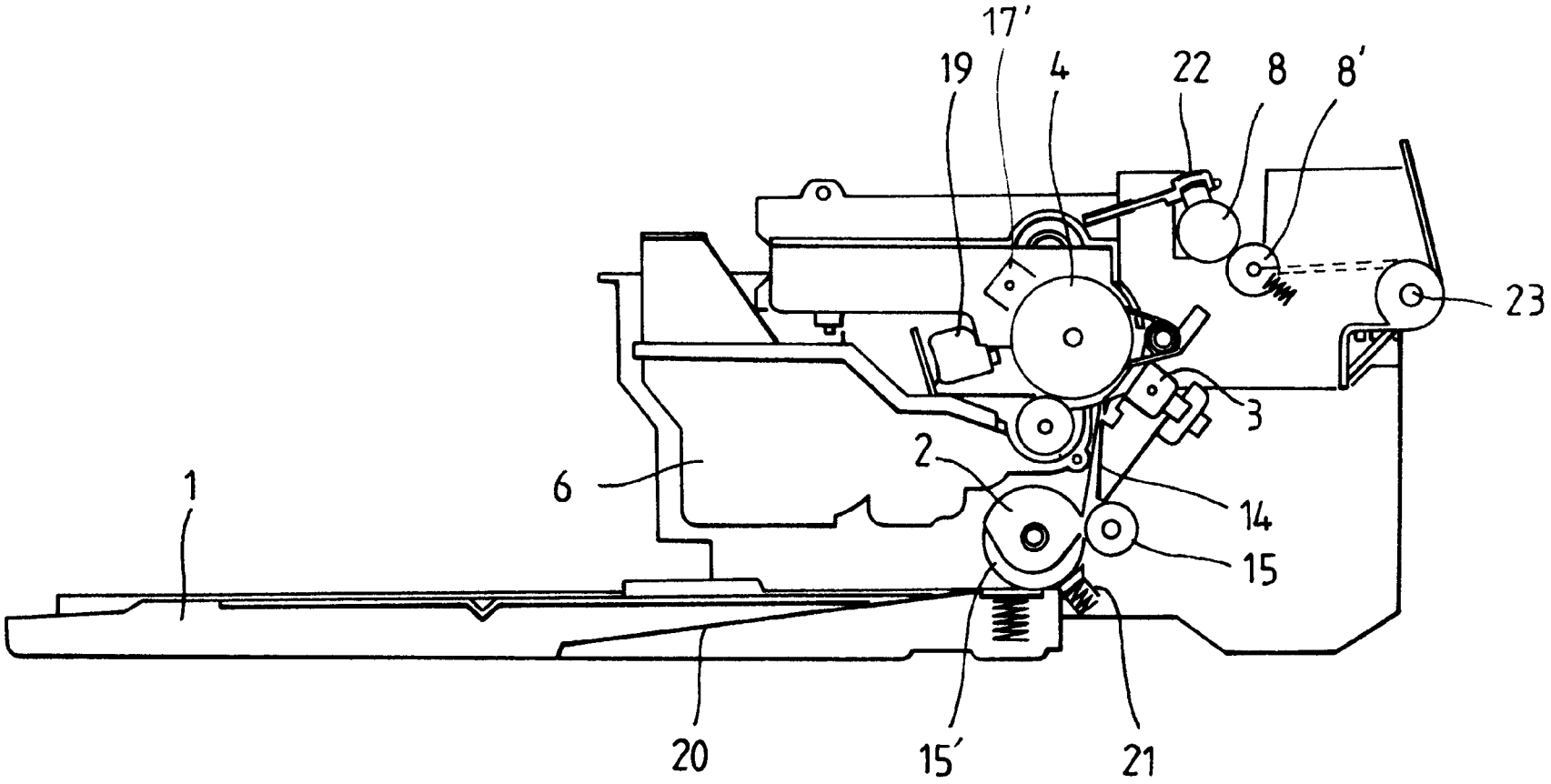
FIG. 2 is a schematic view of an image formation apparatus using electrostatic writing method according to the present invention.
Figure 4:
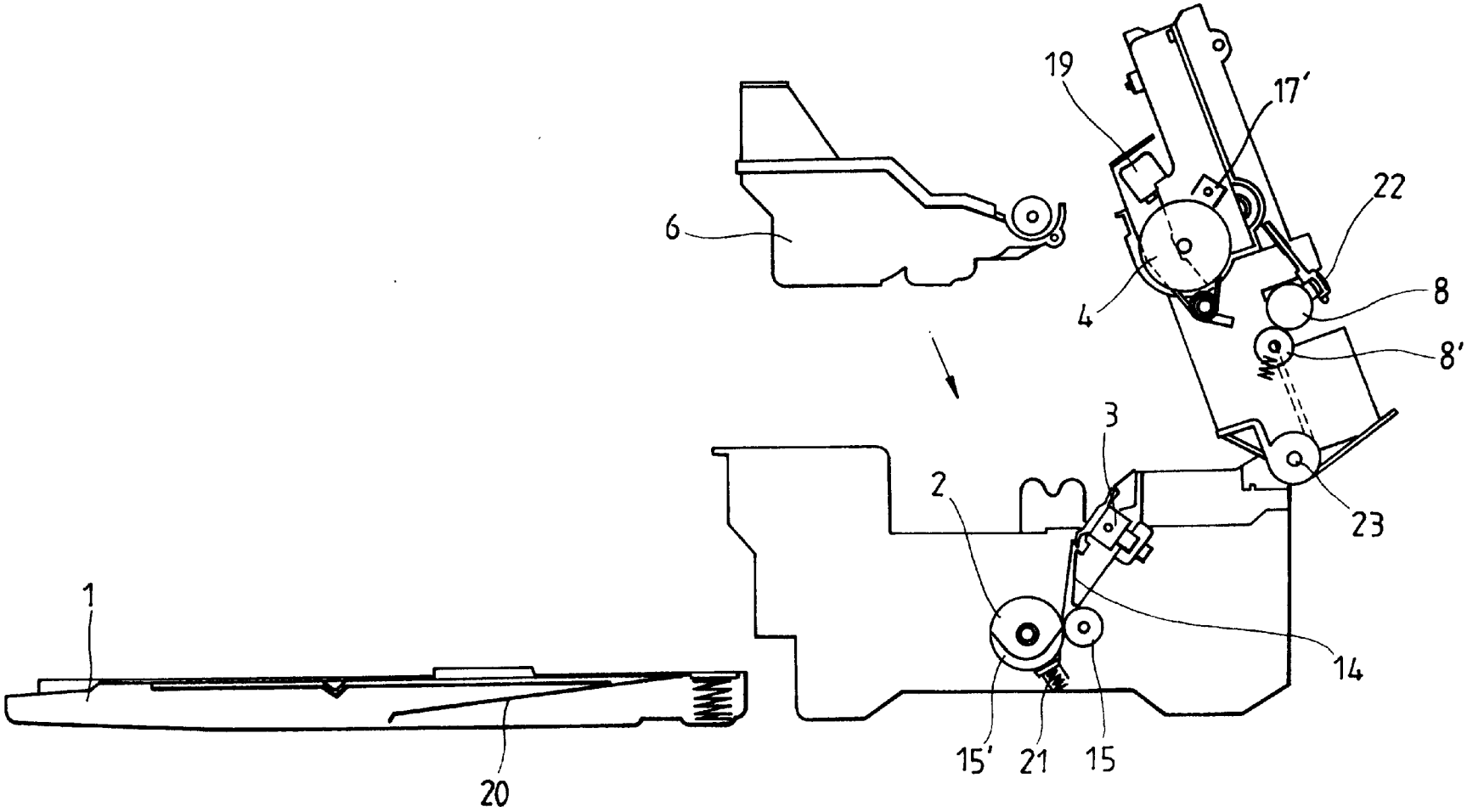
FIG. 4 illustrates the apparatus shown in FIG. 2 when the paper supply cassette and developing device are detached.

Referring to FIG. 2, in the image formation apparatus using electrostatic writing method according to the present invention, a paper supply cassette 1 is mounted in the lower portion of the apparatus, and a paper pressing plate 20 one side of which is supported by a spring is incorporated in the cassette. As shown in FIG. 4, paper supply cassette 1 is detachable to allow the operator to access a portion of a path along which a sheet of paper is to be conveyed, i.e., a paper path, when a sheet of paper becomes jammed in that portion of the paper path between the paper cassette and roller 15' which becomes accessible by the detachment of the paper cassette from the lower portion of the apparatus as shown in FIG. 4. A paper supply roller 2 and paper convey rollers 15 and 15' are located right above paper pressing plate 20. Particularly, roller 15' of larger diameter between the pair of oppositely abutting paper convey rollers and paper supply roller 2 are on the same axis. Paper supply roller 2 is not perfectly circular but is fan shaped, with a portion of the circle being removed. The maximum diameter of the roller 2 is slightly greater than that of paper convey roller 15'. Under a predetermined pressure, paper convey roller 15' of the larger diameter abuts on paper convey roller 15 of the smaller diameter whose contact surface is made of rubber, so as to be rotated by the friction due to the rotation of paper convey roller 15 of the smaller diameter. Here, paper supply roller 2 and paper convey rollers 15 and 15' are rotated at different speeds which produce minute speed differences due to different driving forces, so as to align skewed sheets of paper. A friction pad 21 for separating individual sheets of paper is installed under paper convey roller 15' to be pressed by a spring.

Meanwhile, a detachable developing device 6 is installed above the paper convey rollers, and a paper guide 14 is formed from paper convey roller 15 (of a smaller diameter) to photosensitive drum 4. A transferring device 3 is installed adjacent to paper guide 14, and photosensitive drum 4 is located obliquely above transferring device 3. A portion of the paper path along which a sheet of paper is to be conveyed between the roller 15 and the transferring device 3 becomes accessible to the operator, should a sheet of paper become jammed in that portion of the paper path between the roller 15 and the transferring device 3, by the detachment of the developing device 6 from the lower portion of the apparatus as shown in FIG. 4. A light-emitting diode (LED) 19 for exposure is provided above developing device 6 but on the lower side of photosensitive drum 4. While described later with reference to the drawing, photosensitive drum 4 is detachable. A pair of image fixing rollers 8 and 8' are placed between photosensitive drum 4 and a hinge 23. A cleaning felt 22 for removing remaining toner is located adjacent to the upper image fixing roller S.

Figure 3:
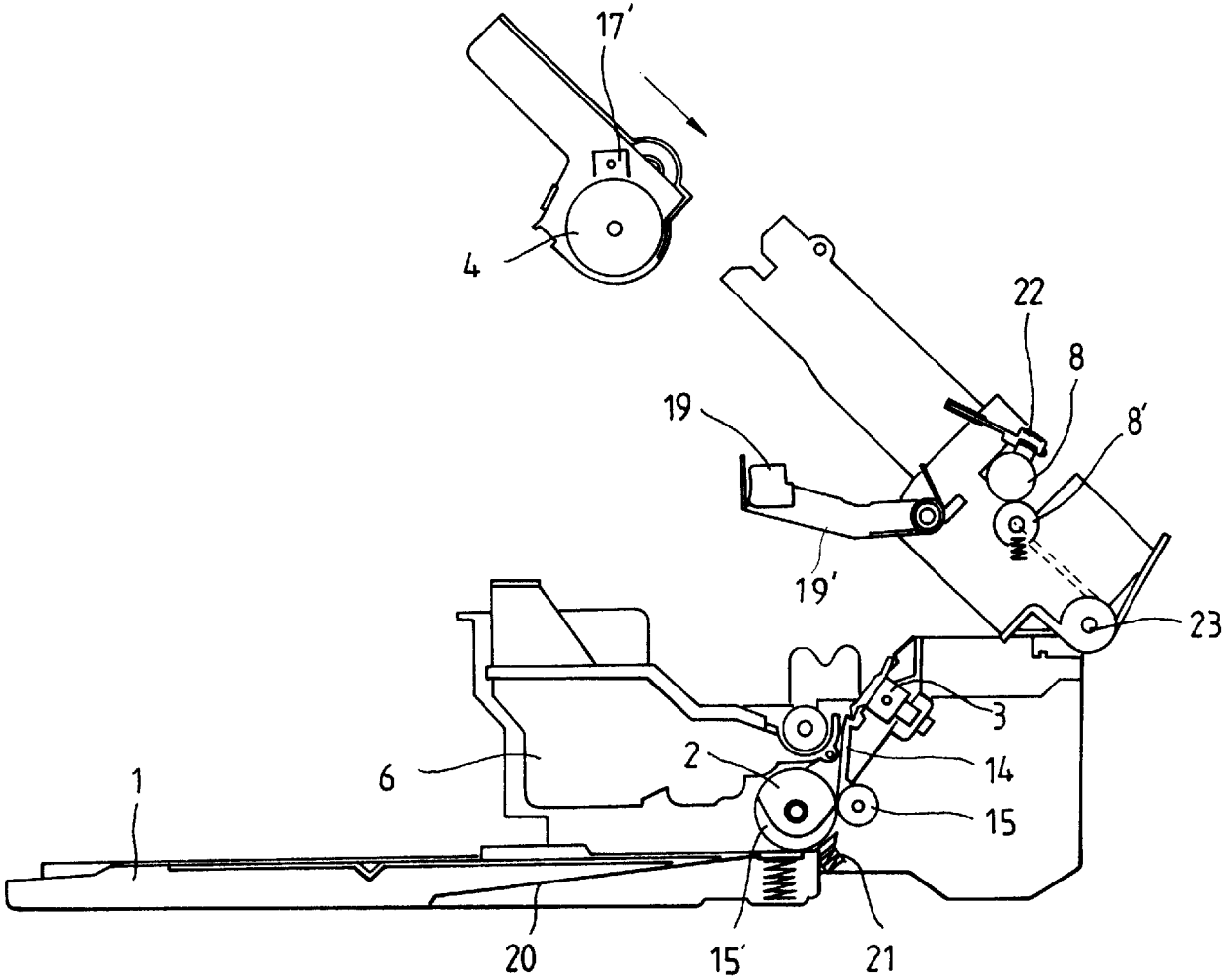
FIG. 3 illustrates the apparatus shown in FIG. 2 when its upper body is opened to and its photosensitive drum is detached.

FIG. 3 shows a state in which the apparatus of the present invention is opened by hinge 23 to allow the operator to access a portion of the paper path when a sheet of paper becomes jammed in that portion of the paper path between transferring device 3 and photosensitive drum 4 which becomes accessible by pivoting the upper portion of the apparatus away from the lower portion of the apparatus by hinge 23 as shown in FIGS. 3 and 4. In FIG. 3, the upper structure of the apparatus is rotatively opened on the axis of hinge 23 and as mentioned before, photosensitive drum 4 is detachable from the upper structure to allow the operator to access a portion of the paper path when a sheet of paper becomes jammed in that portion of the paper path between photosensitive drum 4 and image fixing rollers 8 and 8' which becomes accessible by detaching the photosensitive drum 4 from the upper portion of the apparatus as shown in FIG. 3. Here, in order to separate photosensitive drum 4 from the upper body, the arm 19' having LED 19 should be opened first. Thus, arm 19' is pivotally installed in the upper body by an additional hinge.

FIG. 4 illustrates a state when paper supply cassette 1 and developing device 6 are detached as mentioned before. Accordingly, the image formation apparatus using an electrostatic writing method can be divided into five parts, i.e., upper and lower bodies opened and closed by hinge 23, photosensitive drum 4 detachable from the upper body, developing device 6 detachable from the lower body, and paper supply cassette 1.

Now, the general operation of the image formation apparatus using an electrostatic writing method will be described below.

The top sheet of a paper stack supported by paper pressing plate 20 of paper supply cassette 1 mounted in the lower body is supplied by paper supply roller 2. The supplied sheet is conveyed along paper guide 14 by paper convey rollers 15' and 15. Here, the individual sheets of paper are conveyed by the adequate pressure and friction of friction pad 21. During this step, the first sheet's skewness created during pickup is corrected by a minute difference in speed between paper supply roller 2 and paper convey roller 15'. Then, the paper is transferred to transferring device 3 via paper roller 14. Image information is formed as an electrostatic latent image on the surface of photosensitive drum 4 electrified by an electrifying device 17' by light emitted front an exposing device, that is, LED 19. Developer (colored toner) is supplied onto the drum from developing device 6, and the drum is rotated to transferring device 3. The toner image is transferred to paper at the side of photosensitive drum 4 according to a non-contact corona wire transferring method and then pressed by image fixing rollers 8 and 8' so as to be fixed. By doing this, the paper having the end picture thereon is discharged outside the apparatus. Meanwhile, remaining toner stuck from the paper to image fixing rollers 8 and 8' is removed by cleaning felt 22 installed so as to be in contact with image fixing roller 8.

As described above, in the image formation apparatus using an electrostatic writing method of the present invention, since sheets of paper are conveyed directly to the fixing roller by the paper convey roller, not by a register roller, it is unnecessary to pass through various rollers. This reduces the occurrence of paper jamming and shortens the overall path for paper conveyance as well as the time until discharge of the final picture. Further, a hinge facilitates the opening and closing of the upper and lower bodies of the apparatus. Since the apparatus is constructed to be readily disassembled and reassembled, it is easy to remove paper when caught in any portion of the apparatus due to paper jamming, thereby enhancing the reliability of the apparatus.

What is claimed is:

1. An image formation apparatus capable of easily removing a jammed paper from a paper path in said image formation apparatus, comprising:

upper and lower bodies pivotally combined to each other;

a photosensitive drum detachably combined with said upper body for slidable removal from said upper body in the direction of an axis extending perpendicular to an axis extending in a longitudinal direction through said photosensitive drum, for accessing said paper path;

an arm provided with a light-emitting diode array pivotally installed in said upper body so as to facilitate attachment and detachment of said photosensitive drum;

a developing device detachably installed in said lower body such that said developing device may be completely removed from said lower body for accessing said paper path;

a paper supply cassette detachably installed in said lower body;

lower roller means positioned between said developing device and said paper supply cassette in said lower body, said lower roller means having a paper supply roller and a paper convey roller assembly comprising a first paper convey roller and a second paper convey roller, said paper supply roller having a larger diameter than said first paper convey roller and rotated along a same axis as said first paper convey roller and said second paper convey roller positioned adjacent to said first paper convey roller and rotating along an axis distinct from said first paper convey roller, said paper supply roller separating an individual sheet from a plurality of sheets of paper contained in said paper supply cassette, and said first paper convey roller and said second paper convey roller for receiving said individual sheet and conveying said individual sheet to said photosensitive drum; and image fixing rollers provided opposite said photosensitive drum and installed in said upper body for fixing toner formed on a sheet of paper and discharging said sheet of paper from said image formation apparatus.

2. An image formation apparatus capable of easily removing a jammed paper as claimed in claim 1, wherein said paper supply roller has a fan shaped cross-section.

3. An image formation apparatus capable of easily removing a jammed paper as claimed in claim 1, wherein a friction pad is provided opposing said first paper convey roller, said friction pad for pressing against said first convey roller and separating said individual sheet from said plurality of said sheets of paper as said paper supply roller rotates across said friction pad and engages said individual sheet.

4. An image formation apparatus capable of easily removing a jammed paper as claimed in claim 1, in which a non-contact corona wire transferring method is adapted to said photosensitive drum, and image transformation is carried out at the side of said photosensitive drum.

5. An electrostatic printing device, comprising:

a lower body;

an upper body pivotally attached to said lower body;

a paper cassette for holding sheets of paper detachably installed in said lower body;

an eccentric supply roller disposed above said sheets of paper, for drawing a top sheet of said sheets of paper into said printing device;

a paper guide for receiving said top sheet from said eccentric supply roller and guiding said top sheet;

a photosensitive drum for transferring toner onto said top sheet received via said paper guide, said photosensitive drum being detachably combined with said upper body for complete removal from said upper body for accessing a paper path in said electrostatic printing device;

an light emitting diode array for selectively illuminating said photosensitive drum;

a developing device for selectively transferring toner onto said photosensitive drum after illumination by said light emitting diode array, said developing device being detachably installed in said lower body for complete removal from said lower body for accessing said paper path in said electrostatic printing device; and image fixing rollers directly downstream of said photosensitive drum for permanently affixing said toner to said top sheet and for discharging said top sheet from said printing device.

6. An electrostatic printing device as claimed in claim 5, wherein said light emitting diode array is pivotally attached to said upper body via an arm to enable said photosensitive drum to be slideably removed from said upper body.

7. An electrostatic printing device as claimed in claim 5, wherein said paper cassette comprises a paper pressing plate biased by a spring, adapted to urge said top sheet into engagement with said supply roller.

8. An electrostatic printing device as claimed in claim 5, further comprising a convey roller having an axis of rotation coextensive with an axis of rotation of said eccentric supply roller, for drawing said top sheet into said printing device in cooperation with said eccentric supply roller.

9. An electrostatic printing device as claimed in claim 8, further comprising a second convey roller for cooperating with said first convey roller to convey said top sheet into said printing device.

10. An electrostatic printing device as claimed in claim 8, wherein said supply roller and said convey roller are rotated at different speeds in order to ensure said top sheet is properly aligned.

11. An electrostatic printing device as claimed in claim 5, further comprised of a friction pad for ensuring that said eccentric supply roller only draws said top sheet of said sheets of paper into said printing device.

12. An electrostatic printing device as claimed in claim 5, further comprising a cleaning felt for cleaning said image fixing rollers after contact with said top sheet.

13. An electrostatic printing device as claimed in claim 5, wherein said top sheet is conveyed directly from said photosensitive drum to said image fixing rollers without intervening register rollers.

14. An electrostatic printing device as claimed in claim 5, further comprising said upper body attached by a hinge to said lower body, wherein said upper body houses said photosensitive drum being removeably attached to said upper body, and said light emitting diode array is pivotally attached to said upper body via an arm.

15. An electrostatic printing device as claimed in claim 14, wherein said light emitting diode array is pivotally attached to said upper body via said arm to enable said photosensitive drum to be slideably removed from said upper body.

16. An electrostatic printing device as claimed in claim 14, wherein said developing device is housed in said lower body below said photosensitive drum and said light emitting diode array.

17. An electrostatic printing device, comprising:

a lower body;

an upper body pivotally attached to said lower body;

a paper cassette for holding sheets of paper;

an eccentric supply roller disposed above said sheets of paper, for drawing a top sheet of said sheets of paper into said printing device;

a paper guide for receiving said top sheet from said eccentric supply roller and guiding said top sheet upwards;

a photosensitive drum for transferring toner onto said top sheet received via said paper guide, said photosensitive drum being detachably housed in said upper body for complete removal from said upper body for accessing a paper path in said electrostatic printing device;

a light emitting diode array for selectively illuminating said photosensitive drum, pivotally attached to said upper body via an arm to enable said photosensitive drum to be slideably removed from said upper body;

a developing device installed in said lower body for selectively transferring toner onto said photosensitive drum after illumination by said light emitting diode array; and image fixing rollers downstream of said photosensitive drum for permanently affixing said toner to said top sheet and for discharging said top sheet from said electrostatic printing device.

18. An electrostatic printing device, comprising:

a housing including an upper body pivotally attached to a lower body;

a paper cassette for holding sheets of paper and slidably engaged with said lower body;

an eccentric supply roller disposed above said sheets of paper, for drawing a top sheet of said sheets of paper into said printing device;

a paper guide for receiving said top sheet from said eccentric supply roller and guiding said top sheet upwards;

a photosensitive drum for transferring toner onto said top sheet received via said paper guide, said photosensitive drum detachably housed in said upper body for complete removal from said upper body for accessing a paper path in said electrostatic printing device;

an light emitting diode array for selectively illuminating said photosensitive drum, pivotally attached to said upper body via an arm to enable said photosensitive drum to be slideably removed from said upper body;

a developing device for selectively transferring toner onto said photosensitive drum after illumination by said light emitting diode array, said developing device detachably housed in said lower body for complete removal from said lower body for accessing said paper path in said electrostatic printing device; and image fixing rollers housed is said upper body and downstream of said photosensitive drum for permanently affixing said toner to said top sheet.

19. An electrostatic printing device as claimed in claim 18, wherein said top sheet is converted directly from said photosensitive drum to said image fixing rollers without intervening rollers.

20. An image formation apparatus, comprising:

upper and lower bodies pivotally joined to each other;

a photosensitive drum detachably mounted within said upper body for complete removal from said upper body for accessing a paper path in said image formation apparatus;

an arm provided with a light-emitting diode array pivotally installed in said upper body to accommodate insertion of said photosensitive drum into said upper body;

a developing device detachably installed within said lower body for complete removal from said lower body for accessing said paper path in said image formation apparatus;

a paper supply cassette slidably insertable into said lower body;

lower roller means comprising a paper supply roller and a paper conveying roller, said paper supply roller having a larger diameter than said paper conveying roller, said lower roller means being positioned between said developing device and said paper supply cassette in said lower body with said supply roller directly engaging individual sheets of paper within said supply cassette; and image fixing rollers provided opposite said photosensitive drum, with said photosensitive drum receiving the individual sheets of paper section directly from said supply roller.

21. A method of removing a jammed sheet of paper from a paper path in an image formation apparatus, comprising:

disengaging an upper body of said image formation apparatus from a lower body of said image formation apparatus pivotally attached to said upper body, by pivoting said upper body away from said lower body to access a first portion of said paper path, said first portion of said paper path being located between a photosensitive drum and a transferring device of said image formation apparatus;

removing said jammed sheet of paper from said first portion of said paper path when said jammed sheet of paper is located in said first portion of said paper path;

pivoting an arm provided with a light-emitting diode array pivotally installed in said upper body to facilitate attachment and detachment of said photosensitive drum detachably combined with said upper body;

detaching said photosensitive drum detachably combined with said upper body to access a second portion of said paper path, said second portion of said paper path extending from said photosensitive drum to a plurality of image fixing rollers installed in said upper body for fixing toner formed on a sheet of paper and discharging said sheet of paper from said image formation apparatus;

removing said jammed sheet of paper from said second portion of said paper path when said jammed sheet of paper is located in said second portion of said paper path;

detaching a developing device detachably installed in said lower body to access a third portion of said paper path, said third portion of said paper path extending from said transferring device to a lower roller means installed in said lower body for conveying said sheet of paper from a paper supply cassette to said transferring device;

removing said jammed sheet of paper from said third portion of said paper path when said jammed sheet of paper is located in said third portion of said paper path;

detaching said paper supply cassette detachably installed in said lower body to access a fourth portion of said paper path, said fourth portion of said paper path being located between said paper supply cassette and said lower roller means; and removing said jammed sheet of paper from said fourth portion of said paper path when said jammed sheet of paper is located in said fourth portion of said paper path.

22. A method of removing a jammed sheet of paper from a paper path in an image formation apparatus, comprising:

disengaging an upper body of said image formation apparatus from a lower body of said image formation apparatus pivotally attached to said upper body, by pivoting said upper body away from said lower body;

detaching a developing device detachably installed in said lower body to access a portion of said paper path, said portion of said paper path extending from a transferring device positioned opposite a photosensitive drum detachably installed in said upper body, to a lower roller means installed in said lower body for conveying a sheet of paper from a paper supply cassette to said transferring device; and removing said jammed sheet of paper from said portion of said paper path when said jammed sheet of paper is located in said portion of said paper path.

23. The method of removing a jammed sheet of paper from a paper path in an image formation apparatus as claimed in claim 22, further comprising:

revealing a second portion of said paper path as said upper body is pivoted away from said lower body, said second portion of said paper path being located between said photosensitive drum and said transferring device positioned opposite said photosensitive drum; and removing said jammed sheet of paper when said jammed sheet of paper is located in said second portion of said paper path.

24. The method of removing a jammed sheet of paper from a paper path in an image formation apparatus as claimed in claim 23, further comprising:

pivoting an arm provided with a light-emitting diode array pivotally installed in said upper body to facilitate attachment and detachment of said photosensitive drum detachably combined with said upper body;

detaching said photosensitive drum detachably combined with said upper body to access a third portion of said paper path, said third portion of said paper path extending from said photosensitive drum to a plurality of image fixing rollers installed in said upper body for fixing toner formed on said sheet of paper and discharging said sheet of paper from said image formation apparatus; and removing said jammed sheet of paper from said third portion of said paper path when said jammed sheet of paper is located in said third portion of said paper path.

25. The method of removing a jammed sheet of paper from a paper path in an image formation apparatus as claimed in claim 24, further comprising:

detaching said paper supply cassette detachably installed in said lower body to access a fourth portion of said paper path, said fourth portion of said paper path being located between said paper supply cassette and said lower roller means; and removing said jammed sheet of paper from said fourth portion of said paper path when said jammed sheet of paper is located in said fourth portion of said paper path.

26. The method of removing a jammed sheet of paper from a paper path in an image formation apparatus as claimed in claim 22, further comprising:

pivoting an arm provided with a light-emitting diode array pivotally installed in said upper body to facilitate attachment and detachment of said photosensitive drum detachably combined with said upper body;

detaching said photosensitive drum detachably combined with said upper body to access a second portion of said paper path, said second portion of said paper path extending from said photosensitive drum to a plurality of image fixing rollers installed in said upper body for fixing toner formed on said sheet of paper and discharging said sheet of paper from said image formation apparatus; and removing said jammed sheet of paper from said second portion of said paper path when said jammed sheet of paper is located in said second portion of said paper path.

27. The method of removing a jammed sheet of paper from a paper path in an image formation apparatus as claimed in claim 22, further comprising:

detaching said paper supply cassette detachably installed in said lower body to access a second portion of said paper path, said second portion of said paper path being located between said paper supply cassette and said lower roller means; and removing said jammed sheet of paper from said second portion of said paper path when said jammed sheet of paper is located in said second portion of said paper path.

28. The method of removing a jammed sheet of paper from a paper path in an image formation apparatus as claimed in claim 27, further comprising:

pivoting an arm provided with a light-emitting diode array pivotally installed in said upper body to facilitate attachment and detachment of said photosensitive drum detachably combined with said upper body;

detaching said photosensitive drum detachably combined with said upper body to access a third portion of said paper path, said third portion of said paper path extending from said photosensitive drum to a plurality of image fixing rollers installed in said upper body for fixing toner formed on a sheet of paper and discharging said sheet of paper from said image formation apparatus; and removing said jammed sheet of paper from said third portion of said paper path when said jammed sheet of paper is located in said third portion of said paper path.

29. A method of transferring an image to a sheet of paper in an image formation apparatus having a lower body and an upper body pivotally attached to said lower body, comprising:

separating said sheet of paper from a plurality of sheets of paper contained in a paper supply cassette detachably installed in said lower body with an eccentric supply roller means located in said lower body and disposed above said plurality of sheets of paper;

conveying said sheet of paper along a paper guide to a transferring device located in said lower body opposite a photosensitive drum detachably installed in said upper body;

forming an electrostatic latent image on said photosensitive drum, said electrostatic latent image being produced by light emitted onto said photosensitive drum from an exposing device pivotally installed in said upper body and positioned adjacent to said photosensitive drum and an electrifying device positioned adjacent to said photosensitive drum for electrifying said photosensitive drum, said electrifying device installed to be detached with said photosensitive drum when said photosensitive drum is detached from said upper body;

forming said image by supplying toner to said photosensitive drum from a developing device detachably installed in said lower body;

transferring said image formed from said toner to said sheet of paper as said sheet of paper passes between said photosensitive drum and said transferring device;

conveying said sheet of paper to image fixing means comprising two image fixing rollers positioned adjacent to each other and positioned in said upper body;

fixing said image formed from said toner to said sheet of paper as said sheet of paper passes between said two image fixing rollers; and discharging said sheet of paper directly from said image formation apparatus as said sheet of paper passes between said two image fixing rollers.

* * * * *